United States Patent [19]

Cavezza

[11] 3,995,442

[45] Dec. 7, 1976

[54] AIR CONDITIONING UNIT

[75] Inventor: Norman A. Cavezza, San Ramon, Calif.

[73] Assignee: Fraser-Johnston Company, San Lorenzo, Calif.

[22] Filed: Sept. 29, 1975

[21] Appl. No.: 617,617

[52] U.S. Cl. ..... 62/259; 62/262; 62/297; 62/298; 62/448

[51] Int. Cl.[2] ..... F25D 23/12

[58] Field of Search ..... 62/262, 263, 297, 298, 62/429, 448, 449, 450, 465, 466, 259; 98/94 AC

[56] References Cited

UNITED STATES PATENTS

| | | | |
|---|---|---|---|
| 2,386,883 | 10/1945 | Ames | 62/429 X |
| 2,525,869 | 10/1950 | Corhanidis | 62/448 X |
| 2,569,009 | 9/1951 | Kuempel | 62/429 X |
| 2,945,359 | 7/1960 | MacLeod | 62/298 X |
| 3,289,433 | 12/1966 | Abbott | 62/262 |

*Primary Examiner*—William E. Wayner
*Assistant Examiner*—Ronald C. Capossela
*Attorney, Agent, or Firm*—E. C. Arenz

[57] ABSTRACT

An air conditioning unit of the type adapted for installation externally of the space to be conditioned includes an outer housing separated into internal compartments by interior partition means and includes a belt-driven blower in one compartment for forcing air through heat exchanger means including a refrigerant evaporator, with the motor for driving the blowers being located in a compartment separate from that in which the blowers are located, the motor being cantilever mounted on a wall between the compartments with means provided to fasten the motor so that it may be shifted toward and away from the blowers to adjust belt tension but without uncovering an opening in the wall through which the blower motor shaft projects. Thus motor heat is prevented from mingling with the air which is blown across the refrigerant evaporator.

4 Claims, 4 Drawing Figures

FIG.2
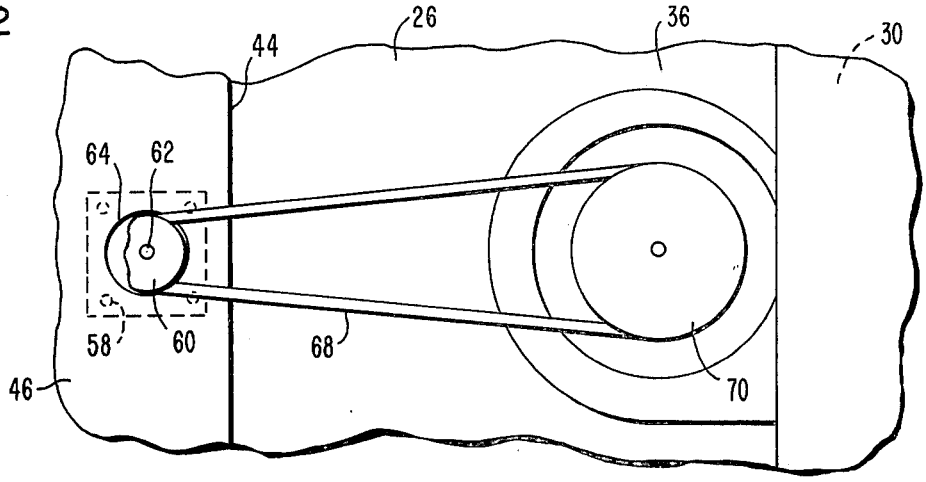
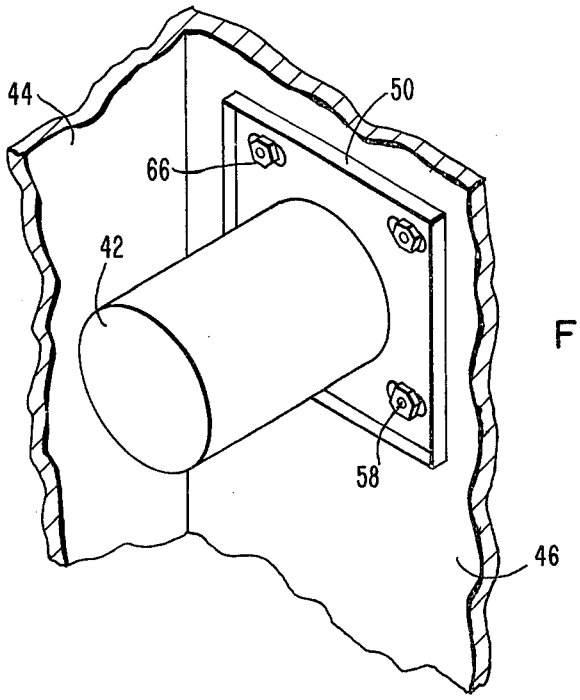
FIG.4
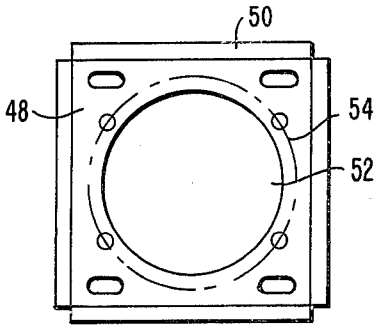
FIG.3

AIR CONDITIONING UNIT

BACKGROUND OF THE INVENTION

1. Field of the Invention

The invention pertains to the art of air conditioning units of the type including a refrigerant evaporator and having belt-driven blowers.

2. Description of the Prior Art

So far as I know the air conditioning units of the type in which this invention is incorporated have typically had the blower motor directly coupled to the blowers, or if the blowers are belt-driven the blower motor is in the same compartment as the blowers. As a result, the heat generated by the operating blower motor adds to the cooling load imposed upon the air conditioning unit.

The aim of the invention is to provide an arrangement in which this motor heat is kept out of the compartments in which the conditioned air flows but which arrangement does not impose difficulties with respect to obtaining proper belt tensioning.

SUMMARY OF THE INVENTION

In accordance with the invention the blower motor is supported in a compartment separate from the compartment through which the conditioned air is passed and an adjustable mounting arrangement is provided for flange mounting the blower motor to a wall separating the compartments with the motor being shiftable toward and away from the blowers to obtain the proper belt tension but without uncovering the opening in the wall through which the blower motor shaft projects.

BRIEF DESCRIPTION OF THE DRAWING

FIG. 2. is a fragmentary elevational view of the belt end of the blower and motor;

FIG. 3 is a face view of the adjustment plate which is secured to the shaft end of the motor; and FIG. 4 is a fragmentary isometric view showing the motor in its mounted position upon a compartment wall.

DESCRIPTION OF THE PREFERRED EMBODIMENT

Figure 1:
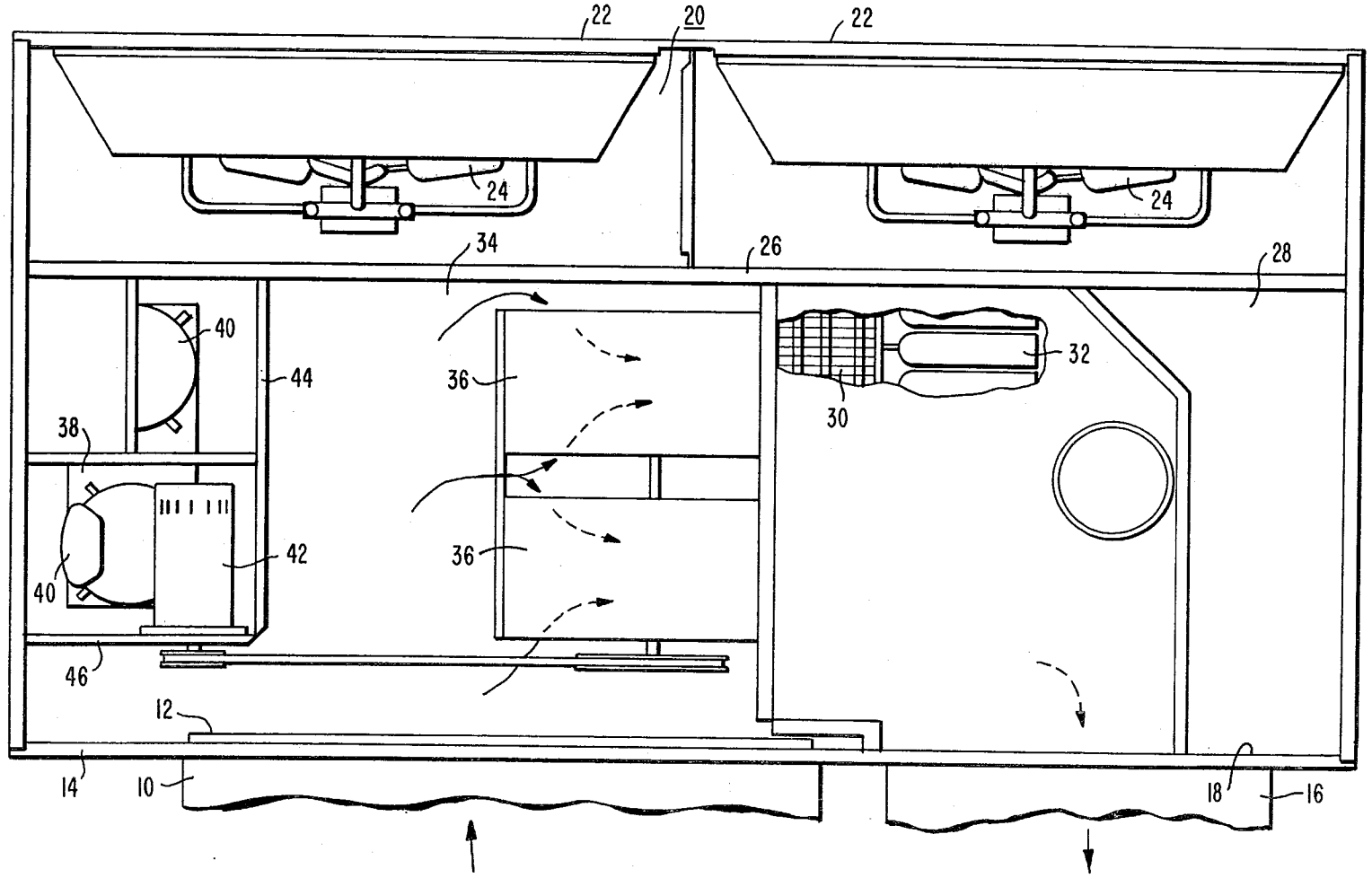
FIG. 1 is a partly diagrammatic plan view of the air conditioning unit with the top wall removed to illustrate the arrangement of interior compartments.

The air conditioning units of FIG. 1 is of the type adapted for installation externally of the space to be conditioned. Thus, the unit may be mounted upon a roof top of the building being served, or upon a slab at the side of the building. Return duct work 10 is connected to an opening 12 in the vertical wall 14 of the outer housing to return air from the conditioned space to the unit. A supply duct 16 is connected to the opening 18 in the vertical wall 14 to carry conditioned air back to the building.

The interior of the outer housing of the air conditioning unit is separated by interior partitions into a number of separate compartments. The condenser and fan compartment 20 contains refrigerant condenser coils 22 and condenser fans 24. The vertical interior partition 26 separates this first compartment 20 from a second compartment 28 which contains heat exchange means including a refrigerant evaporator 30 and in the illustrated unit a gas fired heat exchanger 32. The wall 26 also separates the first compartment 20 from a third compartment 34 which contains the belt-driven blowers 36. The fourth compartment 38 contains a pair of refrigerant compressors 40, an electric motor 42 for driving the blowers and various electrical components and controls such as relays, contactors, etc. (none of which are shown). The fourth compartment is separated from the first compartment by the interior partition 26 and is separated from the third compartment 34 by one wall 44 facing the periphery of the blower scrolls and another wall 46 in a plane generally parallel to the planes of the end walls of the blowers.

Referring to FIGS. 3 and 4, the blower motor 42 is supported in cantilever fashion from wall 46 by what is called a flange mounting arrangement. The mounting arrangement includes a mounting plate 48 which is a generally square plate of extended area in the sense that the plate extends beyond the circumference of the motor. The four borders 50 of the plate are flanged up at a right angle as illustrated in FIG. 4 to provide stiffness to the plate. The plate has a central opening 52 which accommodates a bead on the shaft end of the motor 42 and a bolt circle 54 with four equally spaced bolt holes provided correspond to the belt spacing at the shaft end of the motor and permits securing the plate to the motor end. Four slots 56 are provided in the area of the plate 48 beyond the circumference of the motor.

Four correspondingly spaced threaded studs or bolts 58 are arranged to project from the wall 46 into the compressor and blower motor compartment 38. The plate 48 is secured to the end of the motor 42 by the through bolts of the motor. The motor pulley 60 is secured to the motor shaft 62 (FIG. 2) and the motor assembly may then be moved into place with the slots 56 receiving the bolts 58 and the pulley 60 being moved through the opening 64 in the wall 46. Nuts 66 are then turned onto the bolts 58 to secure the plate 48 to the wall 46.

The slots 56 in the plate permit the motor assembly to be shifted or displaced toward the blower sufficiently to place the belt 68 (FIG. 2) over the blower pulley 70 and the motor pulley 60. The motor assembly is then shifted away from the blowers to obtain the correct belt tension and the nuts 66 are then turned up tightly to secure the motor in that location.

Referring to FIG. 1 again, the direction of air flow through the compartments is indicated by the arrows. It will be seen that with the arrangement according to the invention the heat generated by the blower motor 42 is prevented from passing directly through any opening from the compressor compartment to the blower motor assembly relative to the blowers to obtain the proper belt tension without uncovering the opening through which the blower motor shaft projects.

What is claimed is:

1. An air conditioning unit for installation externally of the space to be conditioned, comprising:

an outer housing;

interior partition means defining separate compartments within said outer housing including a first compartment containing a refrigerant condenser and fan means therefor, a second compartment containing heat exchanger means including refrigerant evaporator means, a third compartment containing belt-driven blower means connected to cause air flow through said second compartment, and a fourth compartment containing refrigerant compressor means and an electric motor having a shaft at one end thereof for driving said blower means;

said interior partition means including a wall separating said third and fourth compartments, said wall having a motor shaft opening therein larger in diameter than said motor shaft;

means for securing said motor to said wall to support it in cantilever fashion therefrom with said motor shaft projecting through said wall opening, said securing means being releasable to permit shifting said motor toward and away from said blower means to adjust belt tension to the proper degree, said wall opening being sized to permit said shifting of said motor to obtain the proper belt tension without uncovering the closure of said opening obtained by the overlying relation of said motor to said opening.

2. An air conditioning unit for installation externally of the space to be conditioned, comprising;

an outer housing;

interior partition means defining separate compartments within said outer housing including a first compartment containing a refrigerant condenser and fan means therefor, a second compartment containing heat exchanger means including refrigerant evaporator means, a third compartment containing belt-driven blower means connected to cause air flow through said second compartment, and a fourth compartment containing refrigerant compressor means and an electric motor having a shaft at one end thereof for driving said blower means;

said interior partition means including a wall separating said third and fourth compartments, said wall having a motor shaft opening larger in diameter than said motor shaft;

said electric motor including a plate having an area extending beyond the circumference of said motor on the shaft end of said motor;

fastening means for securing said plate to said wall in abutting relation thereto to support said motor in cantilever fashion therefrom, with said motor shaft projecting through said wall opening, said fastening means accommodating shifting of said motor toward and away from said blower means to adjust belt tension to the proper degree, said wall opening being sized to permit adequate shifting of said motor to obtain said proper belt tension but remaining covered by said motor end and plate to prevent the passage of air flow between said third and fourth compartments.

3. An air conditioning unit according to claim 2 wherein:

said plate includes peripheral flange means for rigidifying said plate.

4. An air conditioning unit according to claim 2 wherein:

said fastening means includes threaded members projecting from said wall into said fourth compartment; and said plate includes correspondingly spaced slots therein to receive said threaded members therefrom.

* * * * *